United States Patent [19]

Hagiwara et al.

[11] Patent Number: 4,584,034

[45] Date of Patent: Apr. 22, 1986

[54] IRON-BASE AMORPHOUS ALLOYS HAVING IMPROVED FATIGUE AND TOUGHNESS CHARACTERISTICS

[75] Inventors: Michiaki Hagiwara; Akira Menju; Kouhachi Nomura; Akio Nakamura, all of Kyoto, Japan

[73] Assignee: Unitika Ltd., Hyogo, Japan

[21] Appl. No.: 671,840

[22] Filed: Nov. 15, 1984

[30] Foreign Application Priority Data

Nov. 15, 1983 [JP] Japan ..... 58-215533

[51] Int. Cl.[4] ..... C22B 38/02

[52] U.S. Cl. ..... 148/31; 148/31.55; 75/126 B; 75/126 C; 75/126 D; 75/126 E; 75/126 F; 75/126 H; 75/126 P; 75/126 Q; 75/124; 75/125

[58] Field of Search ..... 148/31, 403, 31.55; 75/126 P, 126 Q, 126 B, 126 C, 126 D, 126 E, 126 F, 126 H, 128 R, 124, 125

[56] References Cited

U.S. PATENT DOCUMENTS

| | | | |
|---|---|---|---|
| 4,450,206 | 5/1984 | Ames et al. | 75/126 P |
| 4,473,401 | 9/1984 | Masumoto et al. | 75/126 P |
| 4,473,413 | 9/1984 | Nathasingh et al. | 75/126 P |
| 4,495,691 | 1/1985 | Masumoto et al. | 148/403 |
| 57-169068 | 10/1982 | JPX . | |

*Primary Examiner*—John P. Sheehan

*Attorney, Agent, or Firm*—Sughrue, Mion, Zinn Macpeak & Seas

[57] ABSTRACT

An iron-base amorphous alloy is described, having improved fatigue and toughness characteristics consisting essentially of from 6 to 16 atom % Si, from 7.5 to 16 atom % B, and from 2 to 9 atom % Cr, provided that the composition ranges of Si, B, and Cr are within the quadrangles defined by a-b-c-d of FIG. 1, and $e_1$-$f_1$-$g_1$-$h_1$ of FIG. 2, and the balance being substantially Fe. In addition to improved fatigue and toughness characteristics, the amorphous alloy has excellent tensile break strength, heat resistance, corrosion resistance and electromagnetic properties, and is therefore very useful for industrial reinforcements and electromagnetic materials.

21 Claims, 5 Drawing Figures

FIG. 4
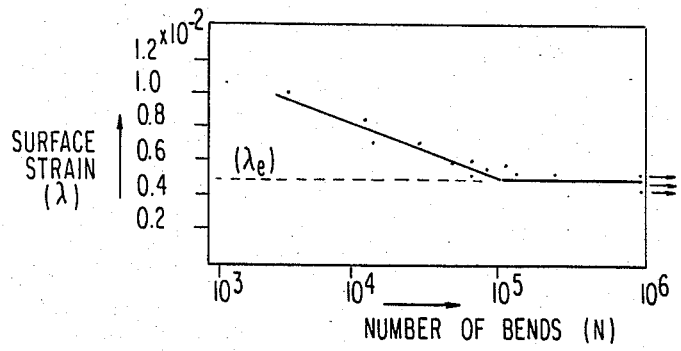
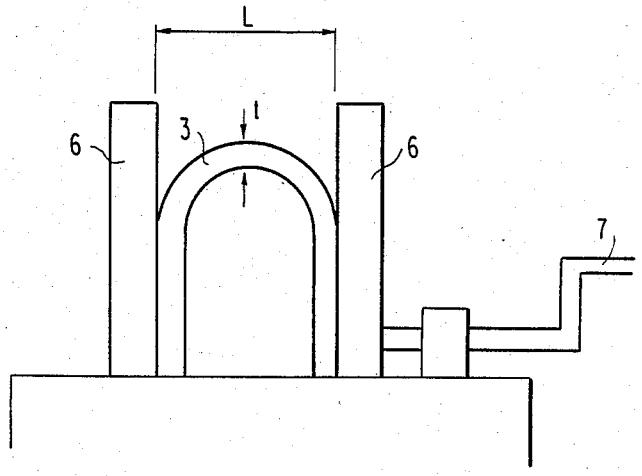
FIG. 5

IRON-BASE AMORPHOUS ALLOYS HAVING IMPROVED FATIGUE AND TOUGHNESS CHARACTERISTICS

BACKGROUND OF THE INVENTION

The present invention relates to iron-base amorphous alloys having improved fatigue and toughness characteristics.

Metals are usually crystalline in their solid state, but selected compositions of metals, when solidified by quenching, lose the initial long-range ordered atomic structure and acquire even in the solid state a structure similar to that of liquids. Such compositions of metals are generally referred to as amorphous alloys. By properly selecting the alloying elements and their amounts, amorphous alloys having better chemical, electromagnetic, physical and mechanical properties than conventional commercial crystalline metals can be obtained. Because of these excellent properties, amorphous alloys have a great potential for use in a wide scope of applications such as electrical and electromagnetic parts, composite materials and fibers. For example, Japanese Patent Application (OPI) Nos. 73920/1976 and 35618/1978 (the symbol OPI as used herein means an unexamined published Japanese patent application) show amorphous alloys having high magnetic permeability characteristics; Japanese Patent Application (OPI) Nos. 101215/1975 and 3312/1976 show amorphous alloys having improved strength and high resistance to corrosion and heat; and U.S. Pat. No. 3,856,513 shows representative amorphous alloys having improved heat stability. Among the amorphous alloys having various distinctive features, iron-base alloys are most promising as materials for making reinforcements in rubber belts and tires, other industrial products such as ropes, because the iron-base alloys can be prepared at low cost, have a higher tensile break strength than existing commercial crystalline metals, involve little or no work hardening and show good balance between strength and toughness. Particularly interesting iron-base amorphous alloys are Fe-Si-B systems which exhibit a high tensile break strength (400 kg/mm$^2$ or more). These Fe-Si-B system alloys are known to have a much higher heat resistance than any other iron-metalloid base amorphous alloys.

Metallic parts are classified as "static" and "dynamic" parts. For the first type of parts, which are usually subject to static forces, materials that have been proved to have good tensile properties, particularly high tensile break strength, are required. However, with dynamic parts, such as belts, tires, ropes, and machine parts, which rotate, bend, vibrate, or reciprocate at high speed, fatigue characteristics are more important than tensile properties, i.e., tensile break strength properties. These dynamic parts are constantly subjected to cyclic applications of external forces for an extended period and the occurrence of vibrations and other undersired effects in usually unavoidable. The deformation accompanying an actual break down is not as great as what occurs in a tensile test, and the tensile break strength for the actual case is far smaller than the tested value; in an extreme case, a fatigue break may even occur under stresses lower than the yield point. No material having a high tensile breaking strength can be effectively used in dynamic parts unless it has good fatigue characteristics. The mechanical properties of various amorphous alloy systems have been reported in many papers which describe the results of tensile and compression tests. On the other hand, few reports have been made on the more important fatigue characteristics, the exceptions being Masumoto and Ogura et al., *Scripta Metallugica,* Vol. 9, pp. 109–114, 1975, which report $Pd_{80}Si_{20}$ amorphous alloy ribbons, and Imura and Doi et al., *Japan J. Appl. Phys.,* Vol. 19, p. 449, 1980 and *Japan J. Appl. Phys.,* Vol. 20, p. 1593, 1981, both of which report Ni-, Fe- and Co- base amorphous alloy ribbons. According to Imura and Doi et al, the fatigue characteristics of $Fe_{75}Si_{10}B_{15}$ amorphous alloy ribbon are comparable to those of the existing crystalline SUS 304 and its fatigue limit ($\lambda e$) is 0.0018. In other words, the high tensile break strength of this particular amorphous system is not reflected in good fatigue properties; to the contrary, its fatigue limit is lower than that of the typical commercial alloy.

Japanese Patent Application (OPI) No. 4017/1976 shows an iron-base amorphous alloy having improved resistance to many types of corrosion (i.e., general corrosion, pitting, crevice corrosion, and stress corrosion cracking) and which contains an Fe-(P,C,B)-Cr alloy as the major component and several other elements as auxiliary components. This alloy is described as being suitable for use as reinforcement cords embedded in rubber and plastic products, such as vehicle tires and belts. Particularly, this application is directed to an iron-base amorphous alloy having high strength and improved resistance to fatigue, general corrosion, pitting, crevice corrosion, stress corrosion cracking and hydrogen embrittlement, said alloy containing as the principal components 1 to 40 atom % of Cr and 7 to 35 atom % of at least one element selected from among P, C and B, and as an auxiliary component a total of 0.01 to 75 atom % of an element of at least one of the groups (1) to (4) shown below, with the balance being substantially Fe:

(1) 0.01 to 40 atom % of Ni or Co or both;

(2) 0.01 to 20 atom % of at least one element selected from among Mo, Zr, Ti, Si, Al, Pt, Mn, and Pd;

(3) 0.01 to 10 atom % of at least one element selected from among V, Nb, Ta, W, Ge, and Be; and (4) 0.01 to 5 atom % of at least one element selected from among Au, Cu, Zn, Cd, Sn, As, Sb, Bi, and S.

The alloy specifically shown in Japanese Patent Application (OPI) No. 4017/1976 is $Fe_{67}Si_{15}B_1P_{13}Cr_3$. While this alloy has high resistance to general corrosion, pitting, crevice corrosion, and stress corrosion cracking, the desired amorphous state cannot be obtained from this alloy having low amorphous forming ability and the fatigue characteristics of the resulting amorphous alloy are not as good as expected. In short, this alloy is not completely satisfactory as a material for use in dynamic parts.

An iron-base amorphous metal filament with a circular cross section and a process for producing the same has been described in European Patent Publication (unexamined) No. 39169 (European Patent Application No. 81301624.3 filed Apr. 14, 1981). The amorphous alloy of which the filament is made has high corrosion resistant, toughness, and good electromagnetic properties, and hence is suitable for use in various industrial materials such as electrical and electronic parts, composites, and fibers. Among the alloys specifically shown in this prior application are Fe-Si-B-Cr systems, such as $Fe_{71}Cr_{10}Si_{10}B_9$, $Fe_{70}Cr_5Si_{10}B_{15}$, and $Fe_{50}Co_{20}Cr_5Si_{10}B_{15}$. Although Cr is incorporated in these alloys, its presence is intended to provide improved resistance to corrosion and heat, as well as enhanced strength, but not to afford improved fatigue characteristics. Stated more specifically, the alloys with 5 atom % of Cr ($Fe_{70}Cr_5Si_{10}B_{15}$ and $Fe_{50}Co_{20}Cr_5Si_{10}B_{15}$) have low levels of fatigue characteristics with little improvement achieved by the addition of Cr. The other alloy, with 10 atom % Cr ($Fe_{71}Cr_{10}Si_{10}B_9$), has low amorphous-forming ability, and the resulting amorphous product does not have a high degree of toughness.

U.S. Pat. No. 4,473,401 describes an iron-base amorphous alloy having improved fatigue characteristics and consisting of not exceeding 25 atom % of Si, 2.5 to 25 atom % of B (Si+B=15 to 35 atom %), 1.5 to 20 atom % of Cr, and the balance being Fe. This alloy had good fatigue characteristics, but on the other hand, it turned out to be somewhat unsatisfactory in toughness. As already mentioned, practical materials which are used in various forms such as twisted, woven, and knitted states should have not only good fatigue characteristics but also high toughness. Materials having improved fatigue characteristics are extremely low in their value as practical products if they do not have great toughness. Practical materials are often put to use after they have been subjected to some deformation, or processed, or treated during the process of making a composite. For example, they are used in a twisted state as reinforcements in rubber belts or tires, or as ropes; in other cases, they are used as filters in a woven or knitted state. Materials that cannot be used after being subjected to such deformation or processing have an extremely limited scope of practical application.

It is generally said that amorphous metals have high toughness. However, this means either that they are tougher than crystalline metals of the same composition (alloy compositions which easily turn amorphous are very brittle in the crysalline state and find no practical uses) or that they are tough for their high degree of strength. In comparison with existing practical materials such as crystalline steel wires and piano wires, the toughness of amorphous metals is rather low. For example, such practical materials can be easily worked by a twisting, weaving, or knitting machine; on the other hand, amorphous wires are subject to frequent breaking when they are worked by the same machine.

SUMMARY OF THE INVENTION

The primary object of the present invention is to provide an iron-base amorphous alloy that has improved fatigue and toughhness characteristics without losing the inherent advantages of amorphous alloys.

As a result of various studies made to achieve this object, the present inventors have found that it can be attained by incorporating a specified amount of Cr in an Fe-Si-B system containing specified amounts of Si and B. More specifically, the present invention provides an iron-base amorphous alloy having improved fatigue and toughness characteristics consisting essentially of from 6 to 16 atom % Si, from 7.5 to 16 atom % B, and from 2 to 9 atom % Cr, provided that the composition ranges of Si, B, and Cr are within the quadrangles defined by a-b-c-d of FIG. 1, and $e_1$-$f_1$-$g_1$-$h_1$ of FIG. 2, i.e., within the hatched areas, with the balance being substantially Fe.

The alloy of the present invention has improved fatigue and toughness characteristics. In addition, it retains the inherent advantages of amorphous alloys (i.e., high tensile break strength, high heat resistance, high corrosion resistance, and good electromagnetic properties). Therefore, the alloy can be used in a wide range of applications such as rubber and plastic reinforcements in belts and tires, materials to be combined with concrete and glass for making composites, reinforcements for various industrial products, knitted and woven products such as fine mesh filters, and electromagnetic materials such as electromagnetic filters and sensors.

BRIEF DESCRIPTION OF THE DRAWINGS

FIG. 4 is a graph showing the λ-N (λ: surface strain and N: number of bends) curve obtained for various alloy samples by the apparatus of FIG. 3; and FIG. 5 is a schematic for an apparatus that is used to determine the toughness characteristics of the alloy of the present invention.

PREFERRED EMBODIMENTS OF THE INVENTION

Figure 1:
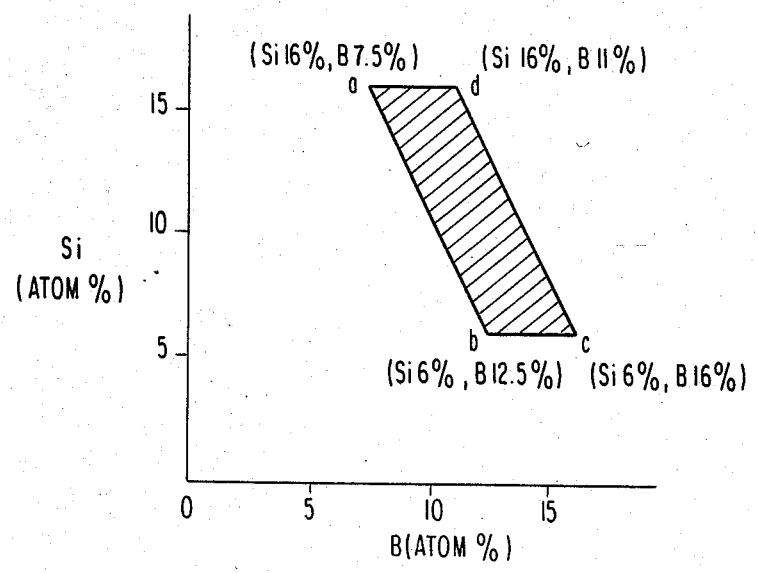
FIG. 1 is a diagram showing the composition ranges of Si and B in the amorphous alloy of the present invention.

The amorphous alloy of the present invention contains from 6 to 16 atom % Si and from 7.5 to 16 atom % B. The composition ranges of Si and B should have the relation indicated by the quadrangle a-b-c-d shown in FIG. 1, wherein a is 16% Si and 7.5% B, b is 16% Si and 12.5% B, c is 6% Si and 16% B, and d is 16% Si and 11% B. If the composition ranges of Si and B are outside the quadrangle a-b-c-d, no improvement in toughness characteristics will be achieved by the addition of Cr. The amorphous alloy of the present invention contains from 2 to 9 atom % Cr. The composition ranges of Si and Cr should have the relation indicated by the quadrangle $e_1$-$f_1$-$g_1$-$h_1$ shown in FIG. 2, wherein $e_1$ is 16% Si and 2% Cr, $f_1$ is 6% Si and 6% Cr, $g_1$ is 6% Si and 9% Cr, and $h_1$ is 16% Si and 7% Cr. If the composition ranges of Si and Cr are outside the quadrangle $e_1$-$f_1$-$g_1$-$h_1$, no improvement in toughness properties can be achieved without sacrificing the fatigue characteristics. As a general rule, an increase in the amount of Cr lends to improved fatigue characteristics, but on the other hand, the toughness characteristics are impaired as a result of increasing the amount of Cr. Surprisingly enough, the fatigue characteristics of the amorphous alloy of the present invention can be improved in the higher Si region even if the Cr content is low. If the addition of Cr is small, there occurs little decrease in the toughness characteristics, and on the contrary, even an improvement in the toughness characteristics will occur. The amount of Cr which is effective in improving the fatigue characteristics is dependent on the amount of Si addition, and the larger the addition of Si, the lower the Cr content that is required. A low Cr level is effective among other things in preventing deteriorated toughness characteristics. For the purpose of striking an optimum balance between fatigue and toughness characteristics, the composition ranges of Si and Cr are preferably within the quadrangles $e_2$-$f_2$-$g_2$-$h_2$ shown in FIG. 2, wherein $e_2$ is 16% Si and 3% Cr, $f_2$ is 6% Si and 6.5% Cr, $g_2$ is 6% Si and 8.5% Cr, and $h_2$ is 16% Si and 6% Cr.

The quaternary Fe-Cr-Si-B alloy of the present invention may contain other elements with a view to providing better electromagnetic characteristics, heat resistance, corrosion resistance, and mechanical properties. More specifically, at least one of Co and Ni may be added in an amount not exceeding 30 atom % for the principal purpose of providing improved electromagnetic characteristics and corrosion resistance; at least one of Ta, Nb, Mo, W, V, Mn, and Zr may be added in an amount not exceeding 10 atom % for the principal purpose of providing improved heat resistance and mechanical characteristics; or at least one of Ta, Nb, Mo, W, Ti, Al, and Cu may be added in an amount not exceeding 10 atom % for the principal purpose of providing improved corrosion resistance. If desired, an amount not exceeding 2 atom % of C may be added for the particular purposes of improving the amorphous forming ability of the alloy and of providing improved strength and fatigue characteristics.

The amorphous alloy of the present invention may be prepared by liquid-quenching techniques wherein a molten alloy of the specified composition is brought into contact with a cold metallic substrate and the heat is rapidly extracted by conduction. Techniques suitable for preparing a flat ribbon include the Pond-Maddin technique (centrifugal quenching) as described in, for example *Tras. Met. Soc. AIME*,245 (1969), 2475, the single roller quenching technique and the double roller quenching technique as described in, for example, *Rev. Sci. Instrum.*, 41 (1970), 1237. An amorphous alloy having a circular cross section may be prepared by spinning in a rotating liquid pool as described in European Patent Publication (unexamined) No. 39169; according to this method, a drum containing a liquid cooling medium is rotated at high speed to form a liquid layer on the inner surface of the drum by centrifugal force, and a molten metal is ejected into that liquid layer and is rapidly cooled. In order to prepare a fine continuous amorphous metallic wire of consistent quality by the last mentioned method, the spinning nozzle should be positioned as close as possible to the surface of the rotating cooling liquid (preferably not more than 5 mm apart), so that the peripheral speed of the rotating drum becomes equal to or greater than the velocity of the stream of molten metal being ejected from the spinning nozzle. It is particularly preferred that the peripheral speed of the rotating drum be from 5 to 30% faster than the velocity of the stream of molten metal being ejected from the spinning nozzle. It is also preferred that the stream of molten metal being ejected from the spinning nozzle forms an angle of 20° or more with the water film formed on the inner surface of the rotating drum.

An amorphous ribbon prepared from the alloy composition of the present invention by the single roller quenching technique was found to have mechanical and thermal properties substantially equal to those of a fine amorphous wire of the same composition that was prepared by spinning in a rotating liquid and which had a circular cross section. However, surprisingly enough, the fine wire had much better fatigue characteristics than the ribbon. It is therefore concluded that the alloy of the present invention having the specified composition can be afforded particularly good fatigue characteristics if it is made a thin amorphous wire with a circular cross section by spinning molten alloy into a rotating liquid. For example, an amorphous ribbon (50 μm thick) that was prepared from $Fe_{70}Cr_5Si_{15}B_{10}$ (this was within the scope of the alloy composition specified by the present invention) by the single roller quenching technique had a tensile break strength of 320 kg/mm$^2$, a fatigue limit (λe) of 0.0045, and a toughness index (ϵ) of 100%. On the other hand, a fine amorphous wire (100 μmΦ) of the same alloy composition that was prepared by spinning in a rotating liquid had respective values of 326 kg/mm$^2$, 0.008 and 95%, indicating the apparent improvement in fatigue characteristics over the amorphous ribbon.

A further advantage of the amorphous alloy of the present invention is its continuous cold workability; for example, a fine uniform amorphous wire can be economically manufactured by drawing a prepared amorphous alloy through a commercial diamond die.

The advantages of the present invention will become even more apparent based on the following working examples and comparative examples. The samples prepared in the examples were checked for their fatigue and toughness characteristics by the following test methods.

Figure 3:
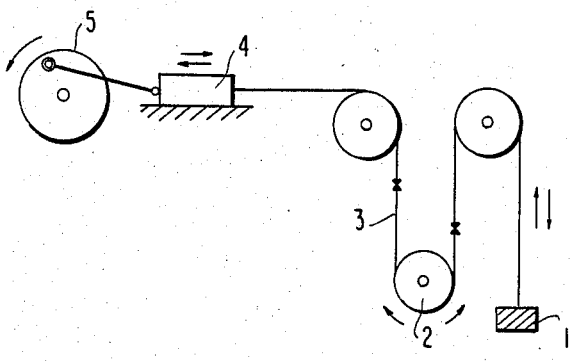
FIG. 3 is a schematic for a deflection type fatigue tester for determining the fatigue characteristics of the alloy of the present invention.

(1) Fatigue Limit (λe): The specimen was set in an ordinary deflection type fatigue tester as illustrated in FIG. 3 capable of affording cyclic bending in one direction. The tester comprised a weight 1 for applying a given load (4 kg) per unit cross-sectional area (1 mm$^2$), a pulley 2 for adjusting the surface strain (λ) of the specimen 3, a horizontally moving slider 4 and a rotary disk 5. At a constant bending cycle (N) of 100 bends/min, the pulley diameter was varied to adjust the surface strain (λ) of the specimen under a predetermined load W (4 kg/mm$^2$). As a result, an λ-N curve of the shape shown in FIG. 4 was obtained, in which λ and N were plotted on the vertical and horizontal axes, respectively. The surface strain at which the curve became flat was taken as the fatigue limit (λe) of the specimen. The formula used to calculate λ was $$\lambda=(t/2r)$$

wherein t is the thickness of the specimen (or diameter if the specimen is a fine wire) and r is the radius of the pulley.

(2) Fatigue ratio (fe): The following formulae were used to calculate fe:

$$fe = \frac{\text{surface strain stress of specimen at fatigue limit (kg/mm}^2)}{\text{tensile break strength (kg/mm}^2)}$$

$$= \frac{\lambda e \times \text{Young's modulus of specimen (kg/mm}^2)}{\text{tensile break strength (kg/mm}^2)}$$

The tensile break strength and Young's modulus of the specimen were determined from the S-S curve (Stress-Strain curve) obtained by measurement with an Instron tensile tester (specimen length: 2 cm, distortion speed: $4.17\times10^{-4}$/sec.).

(3) Toughness index (ϵ): The method described in *Nihon Kinzoku Gakkaishi* (*Journal of the Japan Institute of Metals*), Vol. 42, pp.303–309, 1978 was used, employing a testing apparatus of the type shown in FIG. 5. A specimen 3 was held between two parallel plates 6 which were brought closer by manipulation of a handle 7 until the specimen broke down. The distance (L) between the plates 6 at the specimen breakdown was measured with a micrometer, and substituted into the following equation to calculate the breaking strain, i.e., the toughness index ($\epsilon$)

$$\epsilon = \frac{t}{L - t} \times 100$$

wherein t is thickness of the specimen.

Data were obtained at 20 points of one specimen and averaged. If no break occurs in the specimen that adheres completely to itself (L=2t), $$\epsilon = \left(\frac{t}{2t - t} \times 100\right) = 100.$$

EXAMPLES 1 TO 13 AND COMPARATIVE EXAMPLES 1 TO 13

Alloy samples having the compositions listed in Table 1 were melted in an argon atmosphere and ejected through a ruby spinning nozzle (nozzle hole dia.=0.105 mm$\phi$) at a controlled argon pressure into a rotating cooling liquid (4° C., 3.0 cm deep) that was formed on the inner surface of a cylindrical drum (Inside Diameter=600 mm$\phi$) rotating at 320 rpm. The melts were cooled rapidly into uniform and continuous fine amorphous wires having a circular cross section with an average diameter of 0.100 mm$\phi$.

The tip of the spinning nozzle was held apart from the surface of the rotating cooling liquid at a distance of 1 mm, and the stream of molten metal being ejected from the nozzle formed an angle of 70° with the surface of the rotating cooling liquid. The pressure of the carrier argon gas was so adjusted that the velocity of the molten stream ejecting from the nozzle, which was calculated from the weight of metal collected by ejection into the atmosphere for a given time, was about 570 m/min.

The tensile break strength, fatigue characteristics and toughness index of each amorphous wire sample were determined by measurements at 20° C. and 65% relative humidity and the data obtained are shown in Table 1 below. Data were also taken of a control, i.e., a commercial piano wire (dia.=0.100 mm$\phi$ *alloy designation*=*SWRS* 82A, product designation=SWPA). The results are also shown in Table 1.

TABLE 1

| Sample No. | Alloy Composition (atom %) | Fatigue characteristics: Tensile Break Strength (kg/mm$^2$) | Fatigue Limit ($\lambda e \times 10^2$) | Fatigue Ratio (fe) | Toughness Index ($\epsilon$) |
|---|---|---|---|---|---|
| Comp. Example 1 | Fe75 Si15 B10 | 320 | 0.35 | 0.14 | 12 |
| Comp. Example 2 | Fe73 Cr2 Si15 B10 | 320 | 0.40 | 0.14 | 30 |
| Example 1 | Fe71 Cr4 Si15.5 B9.5 | 323 | 0.65 | 0.26 | 73 |
| Example 2 | Fe71 Cr4 Si15 B10 | 325 | 0.54 | 0.22 | 92 |
| Example 3 | Fe70 Cr5 Si15 B10 | 326 | 0.80 | 0.32 | 95 |
| Comp. Example 3 | Fe72.5 Cr5 Si15 B7.5 | 318 | 0.55 | 0.22 | 2 |
| Comp. Example 4 | Fe67.5 Cr5 Si15 B12.5 | 332 | 0.85 | 0.33 | 5 |
| Comp. Example 5 | Fe68.5 Cr5 Si17.5 B9 | 325 | 1.20 | 0.48 | 6 |
| Example 4 | Fe69 Cr6 Si15 B10 | 328 | 1.05 | 0.42 | 90 |
| Example 5 | Fe68 Cr7 Si15 B10 | 330 | 1.15 | 0.45 | 86 |
| Comp. Example 6 | Fe67 Cr8 Si15 B10 | 330 | 1.15 | 0.45 | 27 |
| Example 6 | Fe72.5 Cr5 Si12.5 B10 | 325 | 0.70 | 0.30 | 76 |
| Example 7 | Fe71.5 Cr6 Si12.5 B10 | 326 | 0.97 | 0.39 | 72 |
| Example 8 | Fe72.5 Cr5 Si10 B12.5 | 331 | 0.50 | 0.20 | 97 |
| Example 9 | Fe71.5 Cr6 Si10 B12.5 | 333 | 0.60 | 0.24 | 95 |
| Example 10 | Fe70.5 Cr7 Si10 B12.5 | 335 | 0.92 | 0.36 | 90 |
| Comp. Example 7 | Fe73 Cr7 Si10 B10 | 320 | 0.88 | 0.36 | 12 |
| Comp. Example 8 | Fe68 Cr7 Si10 B15 | 360 | 0.95 | 0.35 | 4 |
| Example 11 | Fe73 Cr7 Si7.5 B12.5 | 335 | 0.62 | 0.24 | 93 |
| Example 12 | Fe72 Cr8 Si7.5 B12.5 | 337 | 0.92 | 0.36 | 85 |
| Example 13 | Fe69.5 Cr8 Si7.5 B15 | 365 | 0.85 | 0.31 | 67 |
| Comp. Example 9 | Fe74.5 Cr8 Si7.5 B10 | 320 | 0.80 | 0.33 | 8 |
| Comp. Example 10 | Fe67 Cr8 Si7.5 B17.5 | 370 | 0.76 | 0.27 | 3 |
| Comp. Example 11 | Fe71 Cr9 Si7.5 B12.5 | 340 | 0.95 | 0.37 | 7 |
| Comp. Example 12 | Fe73 Cr7 Si5 B15 | 363 | 0.55 | 0.20 | 10 |
| Comp. Example 13 | Piano wire | 285 | 0.55 | 0.34 | 100 |

Figure 2:
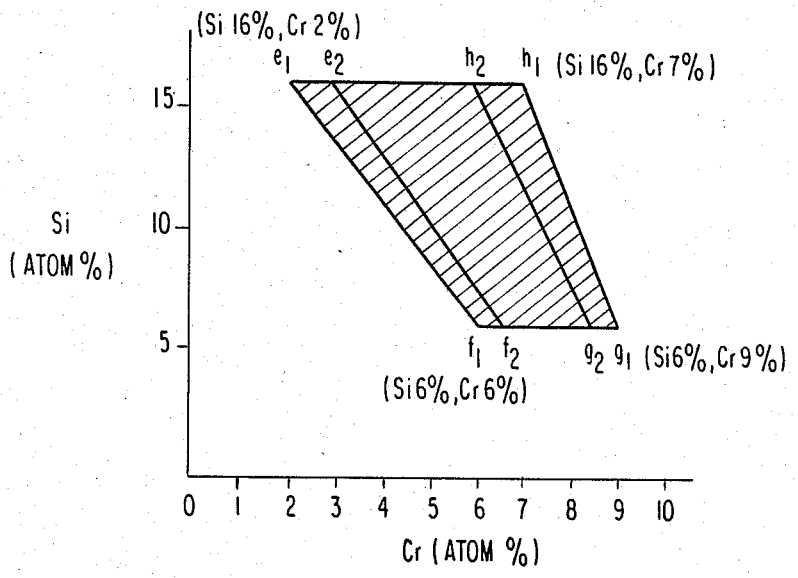
FIG. 2 is a diagram showing the composition ranges of Si and Cr in the amorphous alloy of the present invention.

No improvement in the fatigue characteristics were observed in the samples prepared in Comparative Examples 1 and 2 since their Cr content was outside of the quadrangle $e_1$-$f_1$-$g_1$-$h_1$ shown in FIG. 2. On the other hand, the samples prepared in Comparative Examples 6 and 11 containing Cr in amounts of 8 atom % and 9 atom % respectively had good fatigue characteristics. However, the improvement was not as great as that achieved by the samples prepared in Examples 5 and 12 whose Cr contents were respectively 7 atom % and 8%, and furthermore, the toughness characteristics of the comparative samples were inferior to those of the samples of Examples 5 and 12. The composition ranges of Si and B in the samples prepared in Comparative Examples 3, 4, 7, 8, 10 and 11 were outside the quadrangle a-b-c-d shown in FIG. 1 (excess addition of Si in Comparative Examples 3, 7 and 10, and excess addition of B in Comparative Examples 4, 8 and 11), and hence, no improvement in the toughness characteristics were accomplished. Similarly adverse results were observed in the samples prepared in Comparative Examples 5 and 12 (excess Si in Comparative Example 5 and an undesirably low Si level in Comparative Example 12).

The samples prepared in Examples 1 to 13 were Fe-Cr-Si-B alloys having the Si-B correlation as defined by the quadrangle a-b-c-d and the Si-Cr correlation as defined by the quadrangle $e_1$-$f_1$-$g_1$-$h_1$. As expected, all of these samples struck a good balance between fatigue and toughness characteristics. Given the same Cr level (5 atom %), the fatigue characteristics were improved according to the increasing order of Si level; therefore, the sample of Example 3 containing 15 atom % Si had better fatigue characteristics than the sample of Example 6 (Si=12.5 atom %), which in turn was better than the sample of Example 8 (Si=10 atom %). The same tendency was observed in the samples of Examples 4, 7, and 9 having the same Cr level (6 atom %); the sample of Example 4 containing 15 atom % Si had better fatigue characteristics than the sample of Example 7 containing 12.5 atom % Si, and the latter was better than the sample of Example 9 with the Si level of 10 atom %. In short, given the same Cr level, the fatigue characteristics were improved in the higher Si region. On the other hand, a higher Cr addition is necessary in order to provide better fatigue characteristics in the lower Si region.

Five of the wires prepared in Example 5 were stranded by a conventional twisting machine to form a cord with 300 twists/meter. During the twisting operation, no wire broke and a satisfactory cord could be obtained. However, the wires prepared in Comparative Example 6 had such a low toughness index that they broke too often during the twisting operation to provide a feasible cord.

While the invention has been described in detail and with reference to specific embodiments thereof, it will be apparent to one skilled in the art that various changes and modifications can be made therein without departing from the spirit and scope thereof.

What is claimed is:

1. An iron-base amorphous alloy having improved fatigue and toughness characteristics consisting essentially of from 7.5 to 16 atom % Si, from 7.5 to 16 atom % B, and from 2 to 9 atom % Cr, provided that the composition ranges of Si, B, and Cr are within the quadrangles defined by a-b-c-d of FIG. 1, and $e_2$-$f_2$-$g_2$-$h_2$ of FIG. 2, and the balance being substantially Fe.

2. An iron-base amorphous alloy as in claim 1, wherein the Cr content is from 3 to 8.5 atom %, and the composition ranges of Si and Cr are within the quadrangle defined by $e_2$-$f_2$-$g_2$-$h_2$ of FIG. 2.

3. A thin amorphous wire having a circular cross section, said amorphous wire consisting essentially of from 7.5 to 16 atom % Si, from 7.5 to 16 atom % B, and from 2 to 9 atom % Cr, provided that the composition ranges of Si, B, and Cr are within the quadrangles defined by a-b-c-d of FIG. 1, and $e_2$-$f_2$-$g_2$-$h_2$ of FIG. 2, and the balance being substantially Fe.

4. A thin amorphous wire having a circular cross section as in claim 3, wherein the thin amorphous wire is prepared by spinning a molten alloy into a rotating liquid.

5. A thin amorphous wire having a circular cross section as in claim 3, wherein the Cr content is from 3 to 8.5 atom %, and the composition ranges of Si and Cr are within the quadrangle defined by $e_2$-$f_2$-$g_2$-$h_2$ of FIG. 2.

6. An iron-base amorphous alloy as in claim 1, wherein the alloy additionally contains at least one of Co and Ni, with the total amount thereof not exceeding 30 atom %.

7. An iron-base amorphous alloy as in claim 2, wherein the alloy additionally contains at least one of Co and Ni, with the total amount thereof not exceeding 30 atom %.

8. A thin amorphous wire having a circular cross section as in claim 3, wherein the alloy additionally contains at least one of Co and Ni, with the total amount thereof not exceeding 30 atom %.

9. A thin amorphous wire having a circular cross section as in claim 5, wherein the alloy additionally contains at least one of Co and Ni, with the total amount thereof not exceeding 30 atom %.

10. An iron-base amorphous alloy as in claim 1, wherein said alloy additionally comprises at least one of Ta, Nb, Mo, W, V, Mn, and Zr, with the total amount thereof not exceeding 10 atom %.

11. An iron-base amorphous alloy as in claim 2, wherein said alloy additionally comprises at least one of Ta, Nb, Mo, W, V, Mn, and Zr, with the total amount thereof not exceeding 10 atom %.

12. A thin amorphous wire having a circular cross section as in claim 3, wherein said alloy additionally comprises at least one of Ta, Nb, Mo, W, V, Mn, and Zr, with the total amount thereof not exceeding 10 atom %.

13. A thin amorphous wire having a circular cross section as in claim 5, wherein said alloy additionally comprises at least one of Ta, Nb, Mo, W, V, Mn, and Zr, with the total amount thereof not exceeding 10 atom %.

14. An iron-base amorphous alloy as in claim 1, wherein the alloy additionally contains at least one of Ta, Nb, Mo, W, Ti, Al, and Cu, with the total amount thereof not exceeding 10 atom %.

15. An iron-base amorphous alloy as in claim 2, wherein the alloy additionally contains at least one of Ta, Nb, Mo, W, Ti, Al, and Cu, with the total amount thereof not exceeding 10 atom %.

16. A thin amorphous wire having a circular cross section as in claim 3, wherein the alloy additionally contains at least one of Ta, Nb, Mo, W, Ti, Al, and Cu, with the total amount thereof not exceeding 10 atom %.

17. A thin amorphous wire having a circular cross section as in claim 5, wherein the alloy additionally contains at least one of Ta, Nb, Mo, W, Ti, Al, and Cu, with the total amount thereof not exceeding 10 atom %.

18. An iron-base amorphous alloy as in claim 1, wherein the alloy additionally containing C in an amount not exceeding 2 atom %.

19. An iron-base amorphous alloy as in claim 2, wherein the alloy additionally containing C in an amount not exceeding 2 atom %.

20. A thin amorphous wire having a circular cross section as in claim 3, wherein the alloy additionally containing C in an amount not exceeding 2 atom %.

21. A thin amorphous wire having a circular cross section as in claim 5, wherein the alloy additionally containing C in an amount not exceeding 2 atom %.

* * * * *